US008336937B2

(12) United States Patent
Farrow

(10) Patent No.: US 8,336,937 B2
(45) Date of Patent: Dec. 25, 2012

(54) PIPE PILE SLING

(76) Inventor: Robb Farrow, Lacombe (CA)

( * ) Notice: Subject to any disclaimer, the term of this patent is extended or adjusted under 35 U.S.C. 154(b) by 162 days.

(21) Appl. No.: 12/939,312

(22) Filed: Nov. 4, 2010

(65) Prior Publication Data

US 2012/0112484 A1 May 10, 2012

(51) Int. Cl.
*B66C 1/48* (2006.01)
*E02D 5/22* (2006.01)

(52) U.S. Cl. ..... 294/114; 405/232

(58) Field of Classification Search ..... 166/77.51, 166/77.52, 77.53; 294/114; 405/232
See application file for complete search history.

(56) References Cited

U.S. PATENT DOCUMENTS

| | | | | |
|---|---|---|---|---|
| 176,557 | A * | 4/1876 | Shepard | 294/114 |
| 1,396,317 | A * | 11/1921 | Boyter | 294/102.2 |
| 4,893,860 | A * | 1/1990 | Kurbanov et al. | 294/114 |
| 5,332,047 | A * | 7/1994 | Hignite | 173/1 |
| 5,544,979 | A | 8/1996 | White | |
| 5,609,380 | A * | 3/1997 | White | 294/104 |
| 6,234,719 | B1 | 5/2001 | Roynestad et al. | |
| 6,386,295 | B1 | 5/2002 | Suver | |
| 6,401,811 | B1 * | 6/2002 | Coone | 166/85.1 |
| 6,672,631 | B1 | 1/2004 | Weinhold | |
| 7,300,230 | B2 | 11/2007 | Ong | |
| 7,744,316 | B2 | 6/2010 | Kaufman | |
| 2008/0054662 | A1 | 3/2008 | Lutzhoft et al. | |

* cited by examiner

*Primary Examiner* — Dean Kramer
(74) *Attorney, Agent, or Firm* — Stephen Lewellyn; Stephanus Yang; Maxey Law Offices, PLLC

(57) ABSTRACT

A sling for securing a pipe pile to a pipe pile driving apparatus so that the pipe pile is suspended substantially vertical from the pipe pile driving apparatus is provided. The sling includes a sleeve clamp configured to encircle and clamp against the sleeve for conjoint movement therewith. A pipe pile clamp configured to encircle and clamp against the pipe pile for conjoint movement therewith. First and second pawls are pivotally supported by the pipe pile clamp. The pawls are diametrically opposed and confronting each other and being configured to receive the pipe pile between them. A first suspension tether is connected to and extends between the sleeve clamp and the first pawl. A second suspension tether is connected to and extends between the sleeve clamp and the second pawl, wherein the first and the second pawls pivot in a direction towards each other to clamp against opposing surfaces of a pipe pile positioned between the first and the second pawls when the first and second suspension tethers are tensioned.

5 Claims, 5 Drawing Sheets

PIPE PILE SLING

FIELD OF THE INVENTION

The present invention relates generally to securing pipe pile for lifting and maneuvering into position above a ground surface, and more particularly, relating to a sling device for securing a pipe pile to a vibratory pipe pile driving apparatus for substantial vertical suspension.

BACKGROUND OF THE INVENTION

Pipe piles are commonly used in the construction industry to transfer loads into strong soil layers found deep underground. Conventionally, a pipe pile is a long and large diameter closed or open ended pipe constructed of steel or another suitable material. Because of the weight and size of the pipe pile maneuvering the pipe piles at a construction site presents a challenge. Particularly, in moving the pipe pile from a horizontal position along the ground into a vertical position at a desired driving location.

In certain instances it is desirable to secure the pipe pile to a vibratory driving apparatus to lift and position the pipe pile. An existing system of securing the pipe pile to the driving apparatus includes a hook attached by welding or otherwise to the driving apparatus and securing a single strap at one end to the hook and at the opposite end to the pipe pile in a double wrap and choke. Once the pipe pile is secured by the single strap the pipe pile is lifted. Once lifted the pipe pile suspends crooked requiring two or more workers to steady and vertically straighten the pipe pile for the driving apparatus to engage the pipe pile.

Another existing system includes securing a steel pin through cooperatively aligned holes formed through the end of the pipe pile and a collar depending from the driving apparatus, thereby suspending the pipe pile from the pin. A cable is connected to the pin such that the when the pipe pile is positioned the pin can be removed to permit driving of the pipe pile. This system requires a welder to open aligned holes on opposite surfaces of the pipe pile and also rigidly connects the pipe pile to the driving apparatus, neither of which are desirable.

Accordingly, there is a need and desire for a device that secures a pipe pile to a driving apparatus such that the pipe pile is suspended substantially vertically, does not require modification of the pipe pile and also does not rigidly connect the pipe pile to the driving apparatus.

SUMMARY OF THE INVENTION

The preferred embodiments of the present invention addresses these needs by providing a pipe pile sling for use with a vibrating pipe piling apparatus including a sleeve for receiving an end of a pipe pile to be inserted into a ground surface that overcomes the drawbacks of the existing systems.

To achieve these and other advantages, in general, in one aspect, the pipe pile sling includes a sleeve clamp configured to encircle and clamp against the sleeve for conjoint movement therewith. The sling further includes a pipe pile clamp configured to encircle and clamp against the pipe pile for conjoint movement therewith. First and second pawls are pivotally supported by the pipe pile clamp. The pawls are diametrically opposed and confronting each other and being configured to receive the pipe pile between them. A first suspension tether is connected to and extends between the sleeve clamp and the first pawl. A second suspension tether is connected to and extends between the sleeve clamp and the second pawl, wherein the first and the second pawls pivot in a direction towards each other to clamp against opposing surfaces of a pipe pile positioned between the first and the second pawls when the first and second suspension tethers are tensioned.

There has thus been outlined, rather broadly, the more important features of the invention in order that the detailed description thereof that follows may be better understood and in order that the present contribution to the art may be better appreciated.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The following drawings illustrate by way of example and are included to provide further understanding of the invention for the purpose of illustrative discussion of the embodiments of the invention. No attempt is made to show structural details of the embodiments in more detail than is necessary for a fundamental understanding of the invention, the description taken with the drawings making apparent to those skilled in the art how the several forms of the invention may be embodied in practice. Identical reference numerals do not necessarily indicate an identical structure. Rather, the same reference numeral may be used to indicate a similar feature of a feature with similar functionality. In the drawings.

DETAILED DESCRIPTION OF THE INVENTION

Figure 1:
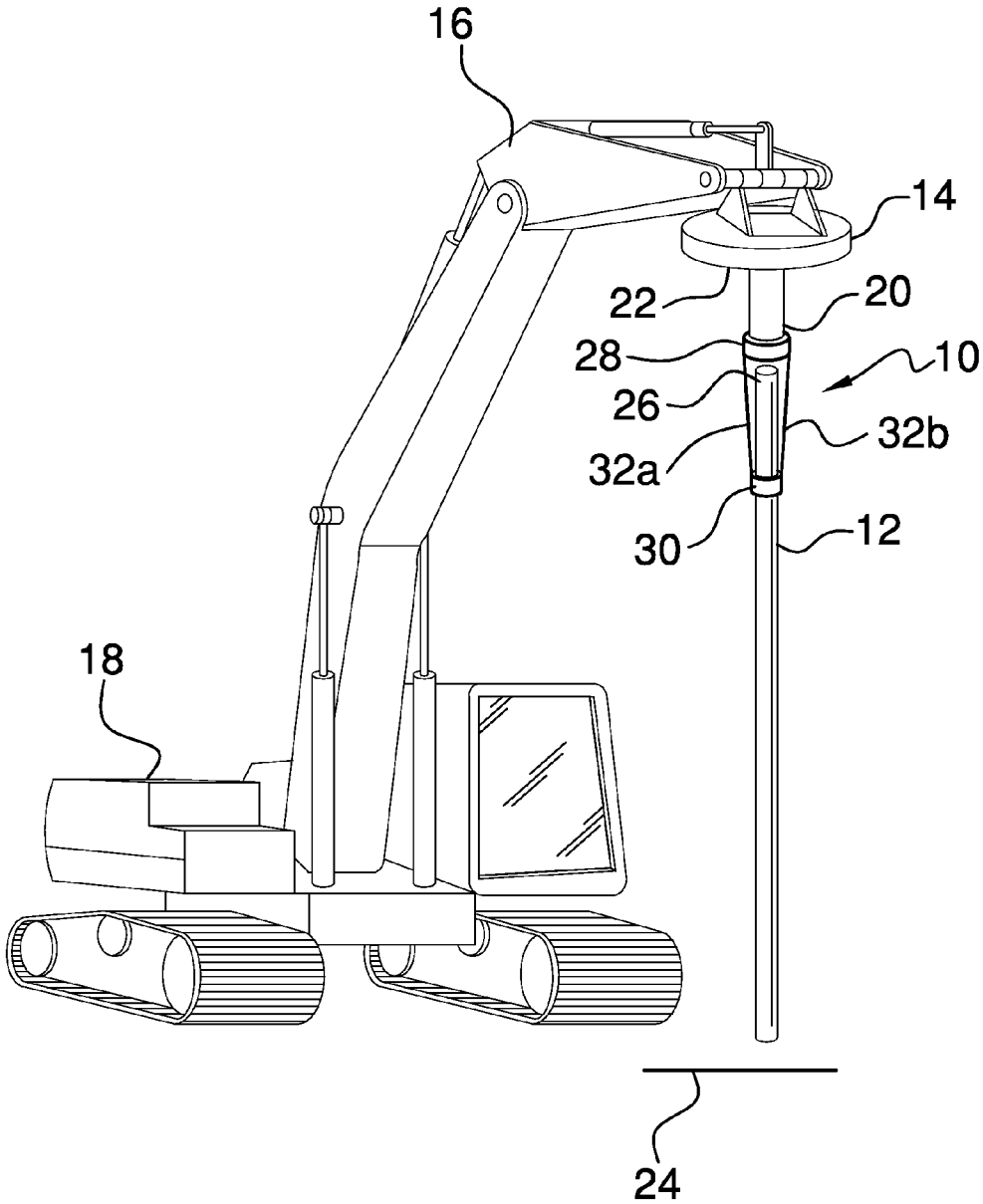
FIG. 1 is a diagrammatic view of the a pipe pile secured to a pipe pile driving apparatus and suspended above the ground by a pipe pile sling constructed in accordance with the principles of the present invention.

As a preliminary matter, it should be noted that in this document (including the claims) directional terms, such as "above", "below", "upper", "lower", "vertical", "horizontal", "top", "bottom", etc., are used for convenience in referring to the accompanying drawings.

With reference now to the drawings, and in particular to FIGS. 1 through 5 thereof, a pipe pile sling embodying the principles and concepts of the present invention and generally designated by the reference numeral 10 will be described.

Figure 2:
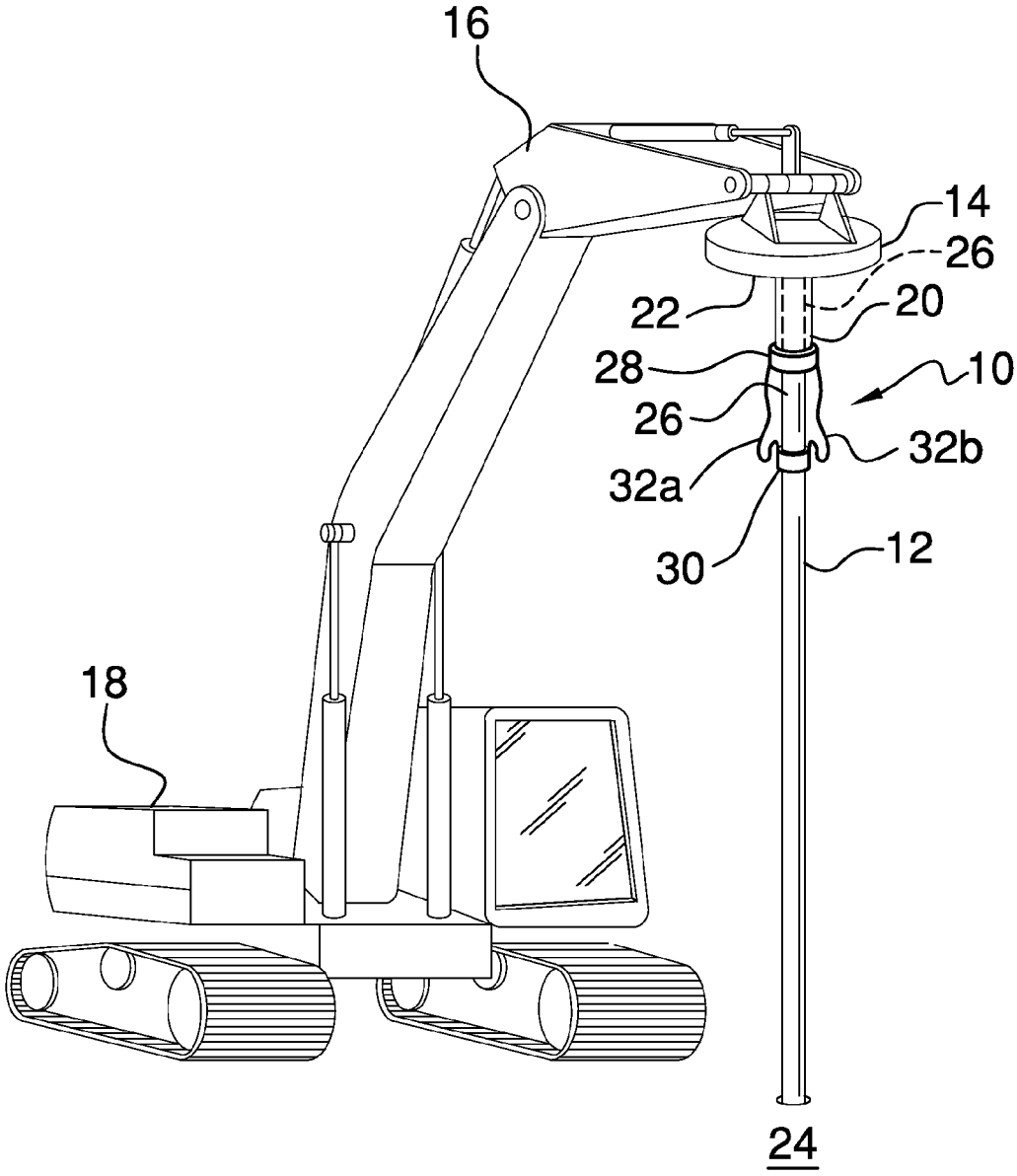
FIG. 2 is a diagrammatic view of a pipe pile being driven into the ground by the pipe pile driving apparatus and the pipe pile sling in a slacked configuration.

Sling 10 provides a tethered connection between a pipe pile 12 and a vibratory pipe pile driving apparatus 14 during lifting and maneuvering of the pipe pile while maintaining the pipe pile in a substantially vertical orientation while suspended above the ground surface 24. In FIGS. 1 and 2, the driving apparatus 14 is supported at the end of a boom 16 of vehicle 18 and is maneuvered through operation of the vehicle and boom. The operation of the vehicle and boom are well known, and as such, a discussion thereof is not necessary for the understanding of the present invention. Additionally, a skilled artisan will readily appreciate, the vehicle 18 depicted as an excavator may be replaced with another suitable vehicle or device capable of maneuvering and operating the driving apparatus 14. The drive apparatus includes a pile sleeve 20 extending from a bottom end 22 thereof. The pile sleeve 20 is configured to receive an end of a pipe pile, such as pile 12, and restrains the relative position of the top end 26 of the pipe pile 12 and the driving apparatus 14, thereby preventing the driving apparatus from slipping of the end during a driving operation where the pipe pile is driven into the ground surface 24.

The sling 10 comprises a sleeve clamp 28 configured to clamp the pile sleeve for conjoint movement therewith. The sleeve clamp 28 includes a pair of confronting semi-circular clamp bands 36*a* and 36*b* defining a circular opening 42 therebetween. Bands 36*a* and 36*b* are joined together at ends 40*a* and 40*b* by an adjustable coupling 38 that operates to adjust the diameter of the circular opening 42 by moving the respective ends 40*a* and 40*b* of the bands toward or away from each other. Coupling 38 comprises a threaded rod 44 extending through pivots 46*a* and 46*b* at ends 40*a* and 40*b*, respectively. Tightening or losing nut 48 causes ends 40*a* and 40*b* to move towards or away from each other, respectively, thus adjusting the size of circular opening 42. Pivots 46*a* and 46*b* permit ends 40*a* and 40*b* to rotate relative to the threaded rod 44 to prevent binding. Opposite ends 50*a* and 50*b* of bands 36*a* and 36*b*, respectively, are joined together by a latch 52 that operates to releasably open and close the sleeve clamp 28 by displacing ends 50*a* and 50*b* towards and away from each other. Latch 52 may include a removable pin 56 preventing opening of the latch. A pair of suspension tether couplings 54*a* and 54*b* are positioned diametrically opposite on bands 36*a* and 36*b*, respectively, and extend outwardly therefrom.

Sling 10 further comprises a pipe pile clamp 30 configured to clamp the pipe pile for conjoint movement therewith. The pipe pile clamp 30, similarly to sleeve clamp 28, includes a pair of confronting semi-circular clamp bands 58*a* and 58*b* defining a circular opening 60 therebetween. Bands 58*a* and 58*b* are joined together at ends 62*a* and 62*b* by an adjustable coupling 64 that operates to adjust the diameter of the circular opening 60 by moving the respective ends 62*a* and 62*b* of the bands toward or away from each other. Coupling 64 comprises a threaded rod 66 extending through pivots 68*a* and 68*b* at ends 62*a* and 62*b*, respectively. Tightening or losing nut 69 causes ends 62*a* and 62*b* to move towards or away from each other, respectively, thus adjusting the size of circular opening 60. Pivots 68*a* and 68*b* permit ends 62*a* and 62*b* to rotate relative to the threaded rod 66 to prevent binding. Opposite ends 70*a* and 70*b* of bands 58*a* and 58*b*, respectively, are joined together by a latch 72 that operates to releasably open and close the pipe pile clamp 30 by displacing ends 70*a* and 70*b* towards and away from each other. Latch 72 may include a removable pin 74 preventing opening of the latch.

A pair of pawls 76*a* and 76*b* are each pivotally attached by pivots 80*a* and 80*b* to stanchions 78*a* and 78*b*, respectively, that are positioned diametrically opposite on bands 36*a* and 36*b*. The pawls 76*a* and 76*b* are confronting and have an space therebetween for the passage of a pipe pile between the pawls. Each pawl 76*a* and 76*b* includes a suspension tether coupling 82*a* and 82*b* at an end opposite pivots 80*a* and 80*b*.

Sling 10 further comprises a pair of suspension tethers 32*a* and 32*b* connected to and extending between sleeve clamp 28 and pipe pile clamp 30. Suspension tether 32*a* is connected at one end to suspension tether coupling 54*a* and at the opposite end to suspension tether coupling 82*a*. Suspension tether 32*b* is connected at one end to suspension tether coupling 54*b* and at the opposite end to suspension tether coupling 82*b*. Suspension tethers 32*a* and 32*b* essentially interconnect the sleeve clamp 28 and the pipe clamp 30 such that the sleeve clamp and the pipe clamp remain secured together but can move in space relative to each other. As depicted suspension tethers 32*a* and 32*b* are of a endless strap configuration wound about suspension tether couplings 54*a*, 54*b*, 82*a* 82*b*. A skilled artisan will recognize the endless strap configuration could be replaced by other suitable configurations without departing from the scope of the invention. Additionally, other suitable suspension tether couplings may also be employed as desired.

Figure 3:
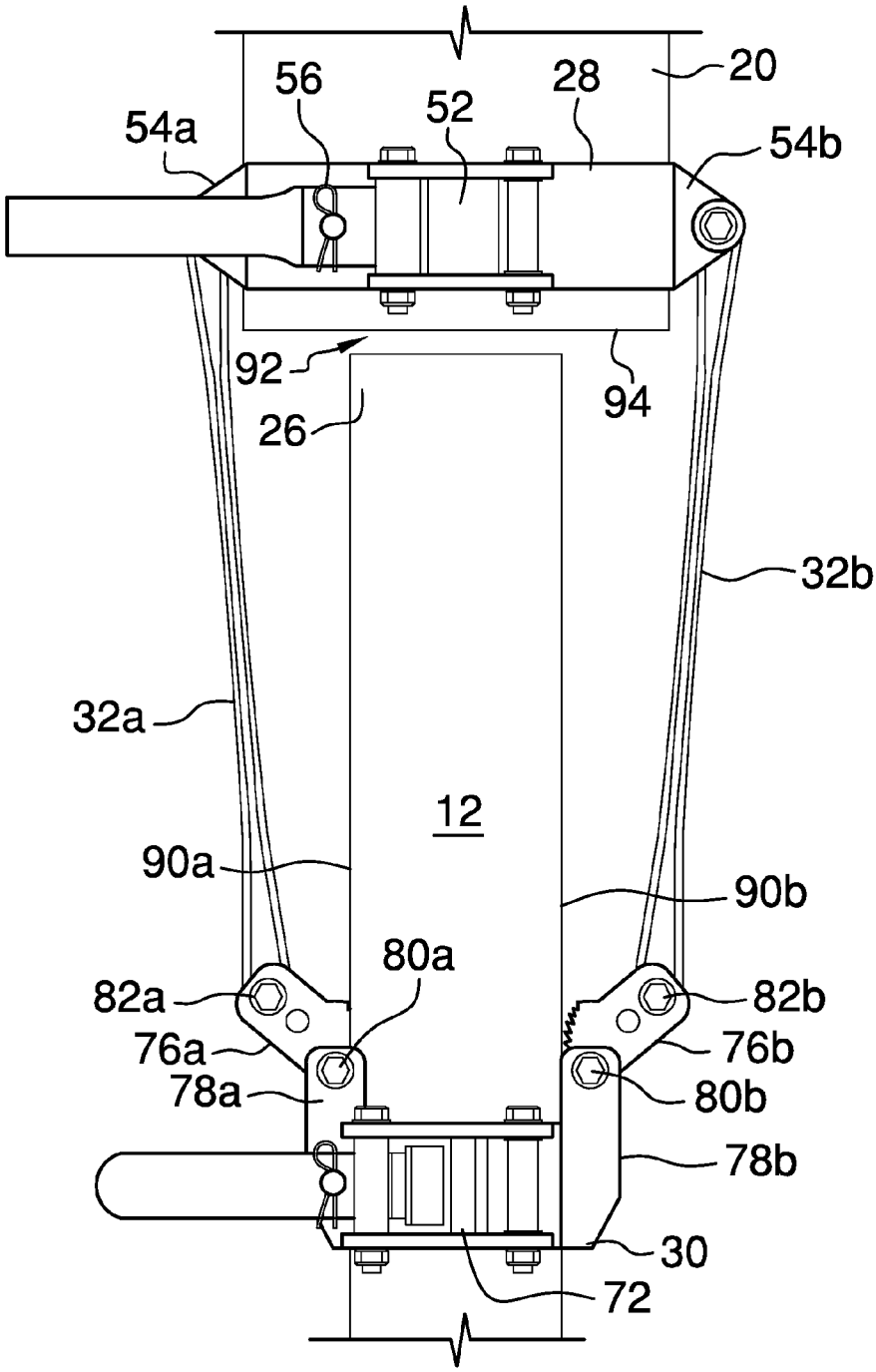
FIG. 3 is an enlarged, partial schematic illustration of the pipe pile suspended from the pipe pile driving apparatus by the pipe pile sling.
Figure 4:
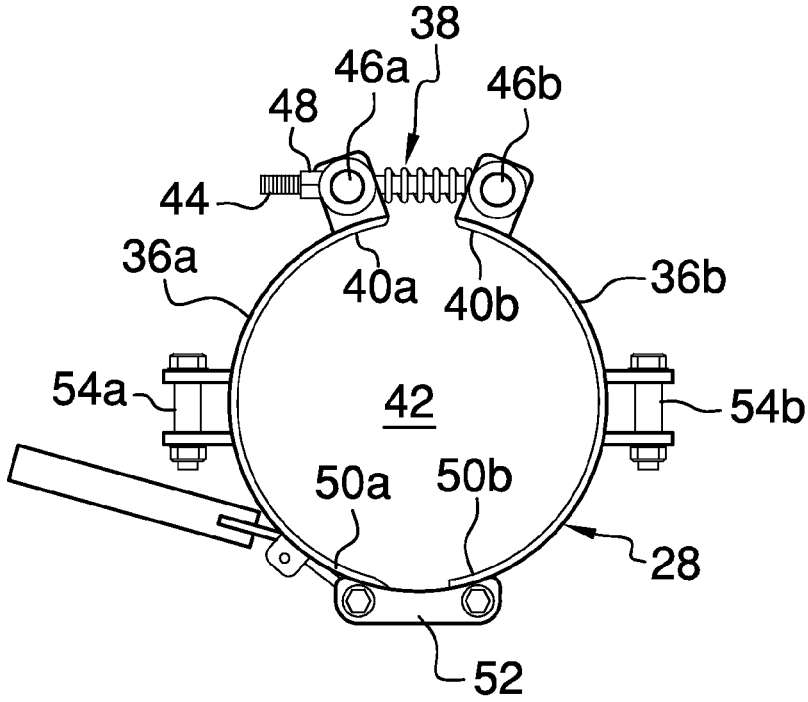
FIG. 4 is a schematic top view of a sleeve clamp of the pipe pile sling.
Figure 5:
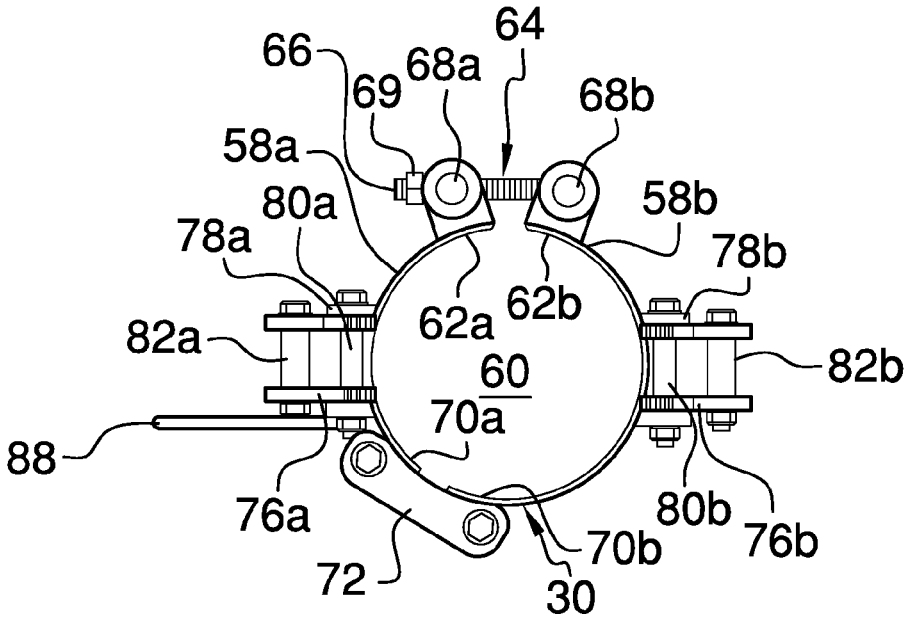
FIG. 5 is a schematic top view of a pipe pile clamp of the pipe pile sling.
Figure 6:
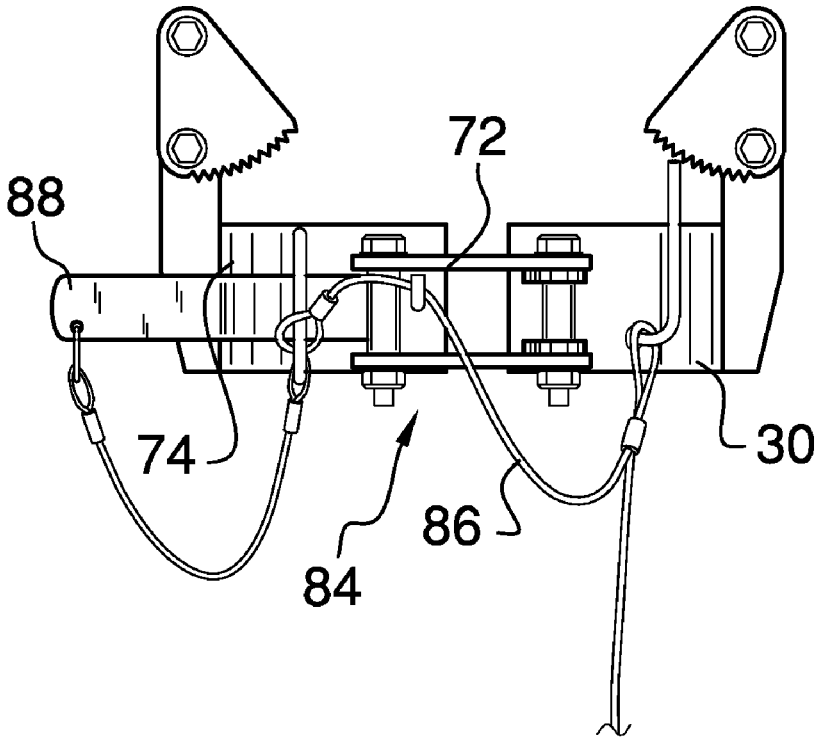
FIG. 6 is a schematic view of the pipe pile clamp illustrating a safety release.

An upward tension applied to suspension tethers 32*a* and 32*b*, such as during lifting and suspending a pipe pile 12, result in pawls 76*a* and 76*b* rotating in an inwardly direction towards one another to clamp against opposing surfaces 90*a* and 90*b* the pipe pile 12 positioned between the pawls, as best seen in FIG. 3. With the pawls 76*a* and 76*b* clamped against the pipe pile 12, the pipe pile is prevented from slipping from the pipe pile clamp 30 as the pipe pile is lifted and suspended. The clamping force applied to the pipe pile 12 is a function of the weight of the pipe pile 12.

In an embodiment, the sling 10 may include a safety release 84 that can be operated to release latch 72 of the pipe pile clamp 30 from a safe distance to release the pipe pile clamp from the pipe pile 12. The safety release 84 includes a cable 86 connected to pin 74 in a manner such that pulling on cable results in pin 74 becoming disconnected and permitting rotation of the latch handle 88. Cable 86 may also be connected to the outward end of latch handle 88.

It operation, the sleeve clamp 28 is secured to pipe sleeve 20 by adjusting the size of opening 42 such that the bands 36*a* and 36*b* are securely clamped against the pipe sleeve when latch 52 is operated. The sleeve clamp 28 is positioned about the pipe sleeve 20 and the latch 52 is operated and secured by pin 56, thereby clamping the sleeve clamp to the pipe sleeve. Similarly, pipe pile clamp is secured to the pipe pile 12 by adjusting the size of the opening 60 such that bands 58*a* and 58*b* are securely clamped against the pipe pile when latch 72 is operated. The pipe pile clamp 30 is positioned about and clamped to the pipe pile 12 at an inwardly spaced distance from the end 26 of the pipe pile such that when the pipe pile 12 is suspended, and the suspension tethers 32*a* and 32*b* are tensioned, there is a gap 92 between the bottom 94 the sleeve 20 and the end 26 of the pipe pile, FIG. 3. Once the sleeve clamp 28 and the pipe pile clamp 30 are secured the pipe pile 12 is lifted by maneuvering the driving apparatus 14 into a vertically suspended position (as seen in FIG. 1) where it can be positioned for driving into ground 24.

An important aspect of the sling 10 of the present invention can be seen in FIG. 2, where the driving apparatus 14 is operating to drive the pipe pile 12 into the ground 24. End 26 is disposed within pile sleeve 20 and engaged with driving apparatus 14 in a known manner to drive pipe pile 12 into the ground 24. Suspension tethers 32*a* and 32*b* are slacked as a result of end 26 being inserted into pile sleeve 20 and sleeve clamp 28 and pipe pile clamp 30 positioned closer together. The slack in suspension tethers 32*a* and 32*b* permits relative vertical displacement between the end 26 of the pipe pile 12 and the driving apparatus 14, thereby preventing a binding between the pipe pile and the driving apparatus that otherwise may impede correct driving of the pipe pile and present a safety hazard to workers.

A number of embodiments of the present invention have been described. Nevertheless, it will be understood that various modifications may be made without departing from the spirit and scope of the invention. Accordingly, other embodiments are within the scope of the following claims.

What is claimed is:

1. A pipe pile sling for use with a vibrating pipe piling apparatus including a sleeve for receiving an end of a pipe pile to be inserted into a ground surface, the pipe pile sling comprising:

a sleeve clamp configured to encircle and clamp against the sleeve for conjoint movement therewith, wherein said sleeve clamp includes a pair of confronting clamp bands;

a pipe pile clamp configured to encircle and clamp against the pipe pile for conjoint movement therewith, wherein said pipe pile clamp includes a pair of confronting clamp bands;

a first and second pawls pivotally supported by said pipe pile clamp, said first and second pawls diametrically opposed and confronting each other and being configured to receive the pipe pile between them;

a first suspension tether connected to and extending between said sleeve clamp and said first pawl;

a second suspension tether connected to and extending between said sleeve clamp and said second pawl; and wherein said first and said second pawls pivot in a direction towards each other to clamp against opposing surfaces of a pipe pile positioned between said first and said second pawls when said first and second suspension tethers are tensioned.

2. The pipe pile sling of claim 1, wherein said sleeve clamp includes an adjustable coupling connecting said clamp bands of said sleeve clamp; and wherein said pipe pile clamp includes an adjustable coupling to connect to said clamp bands of said pipe pile clamp.

3. The pipe pile sling of claim 1, wherein said first and said second suspension tethers are endless straps.

4. The pipe pile sling of claim 1, further comprising:

a safety release connected to said pipe pile clamp.

5. The pipe pile sling of claim 4, wherein said safety release includes a latch with a handle connected to said pipe pile clamp, said latch being secured to said pipe pile clamp by a pin connected to a cable; and wherein pulling on said cable operatively disconnects said pin from said pipe pile clamp, permitting the rotation of said latch handle to operatively release said latch of said pipe pile clamp from said pipe pile.

* * * * *